US007601061B2

(12) United States Patent
Jackson

(10) Patent No.: US 7,601,061 B2
(45) Date of Patent: Oct. 13, 2009

(54) GAMING MACHINE HAVING INDEPENDENT SPINNING FORMS AND MULTIPLE PAY LINES

(75) Inventor: Kathleen Nylund Jackson, Scituate, MA (US)

(73) Assignee: IGT, Reno, NV (US)

( * ) Notice: Subject to any disclaimer, the term of this patent is extended or adjusted under 35 U.S.C. 154(b) by 284 days.

(21) Appl. No.: 11/057,393

(22) Filed: Feb. 11, 2005

(65) Prior Publication Data

US 2006/0183532 A1 Aug. 17, 2006

(51) Int. Cl.
*A63F 13/00* (2006.01)

(52) U.S. Cl. ..... 463/20; 463/16; 463/19; 463/22; 273/138.1

(58) Field of Classification Search ..... 463/16–23, 463/30–34; 273/139, 142 H, 142 HA, 142 R, 273/145 R, 147, 243, 138.1, 141 R, 143 R, 273/142 B, 146, 268, 461
See application file for complete search history.

(56) References Cited

U.S. PATENT DOCUMENTS

| | | | |
|---|---|---|---|
| 355,947 | A | 1/1887 | Parfitt |
| 636,508 | A | 11/1899 | Eickershoff |
| 818,895 | A | 4/1906 | Kuhn |
| 1,463,290 | A | 7/1923 | Moulder |
| 1,520,316 | A | 12/1924 | Stolper |
| 1,564,746 | A | 12/1925 | Barnard |
| 1,689,380 | A | 10/1928 | DeBary |
| 1,978,395 | A | 10/1934 | Groetchen |
| 2,545,644 | A | 3/1951 | Benton et al. |
| D164,309 | S | 8/1951 | McManus |
| D208,030 | S | 7/1967 | Weinard |
| 3,420,525 | A | 1/1969 | Waders |
| 3,642,287 | A | 2/1972 | Lally et al. |
| 3,667,757 | A | 6/1972 | Holmberg |
| 3,735,987 | A | 5/1973 | Ohki |
| 3,975,022 | A | 8/1976 | Figueroa |
| 3,977,681 | A | 8/1976 | Deitrich |
| 4,099,722 | A | 7/1978 | Rodesch et al. |

(Continued)

FOREIGN PATENT DOCUMENTS

| | | |
|---|---|---|
| AU | 74936/87 | 6/1987 |

(Continued)

OTHER PUBLICATIONS

3-Way-Action Poker Advertisement, written by IGT, published in 2002.

(Continued)

*Primary Examiner*—Dmitry Suhol
*Assistant Examiner*—Arthur O. Hall
(74) *Attorney, Agent, or Firm*—K & L Gates LLP

(57) ABSTRACT

A display is provided on which symbols may be provided for use in a slot-type wagering game. Symbols are displayed on sectioned geometrical shapes such as ovals, squares, circles, polygons, etc. Specific symbol combinations, particularly comprised of one symbol appearing on one section of each sectioned geometric shape or all symbols appearing on all sections of one sectioned geometric shape, may constitute a winning combination according to a predetermined pay table. Preferably the invention incorporates three 3-section circular reels, providing 30 different pay lines and an additional pay line incorporating all nine sections of the reels.

12 Claims, 10 Drawing Sheets

U.S. PATENT DOCUMENTS 4,198,052 A 4/1980 Gauselmann
D260,769 S 9/1981 Thomas
D261,782 S 11/1981 Muir
4,326,351 A 4/1982 Heywood et al.
4,410,178 A 10/1983 Partridge
4,448,419 A 5/1984 Telnaes
4,517,558 A 5/1985 Davids
4,618,150 A 10/1986 Kimura
4,621,814 A 11/1986 Stepan et al.
4,624,459 A 11/1986 Kaufman
4,651,996 A 3/1987 Watkins, Jr.
4,676,506 A 6/1987 Crouch
4,695,053 A 9/1987 Vazquez, Jr. et al.
4,732,386 A 3/1988 Rayfiel
4,743,024 A * 5/1988 Helm et al. ..... 273/143 R
4,756,531 A 7/1988 DiRe et al.
4,790,537 A 12/1988 Smyth et al.
4,805,907 A 2/1989 Hagiwara
4,817,951 A 4/1989 Crouch et al.
4,826,169 A 5/1989 Bessho et al.
4,836,553 A 6/1989 Suttle et al.
4,838,552 A 6/1989 Hagiwara
4,861,041 A 8/1989 Jones et al.
4,871,171 A 10/1989 Rivero
4,874,173 A 10/1989 Kishishita
4,941,665 A 7/1990 Klamer
4,978,129 A 12/1990 Komeda et al.
4,991,848 A 2/1991 Greenwood et al.
5,019,973 A 5/1991 Wilcox et al.
5,046,736 A 9/1991 Bridgeman et al.
5,058,893 A 10/1991 Dickinson et al.
5,078,405 A 1/1992 Jones et al.
5,085,436 A 2/1992 Bennett
5,088,737 A 2/1992 Frank et al.
5,098,107 A 3/1992 Boylan et al.
5,100,137 A 3/1992 Fulton
5,102,134 A 4/1992 Smyth
5,102,137 A 4/1992 Ekiert
5,152,529 A 10/1992 Okada
5,167,413 A 12/1992 Fulton
5,184,821 A 2/1993 Korenek
RE34,244 E 5/1993 Hagiwara
5,209,479 A 5/1993 Nagao et al.
5,251,897 A 10/1993 Fulton
5,259,616 A 11/1993 Bergmann
5,308,065 A 5/1994 Bridgeman et al.
5,332,228 A 7/1994 Schultz
5,342,047 A 8/1994 Heidel et al.
5,342,049 A 8/1994 Wichinsky et al.
5,344,144 A 9/1994 Canon
5,364,100 A 11/1994 Ludlow et al.
5,375,830 A 12/1994 Takemoto et al.
5,393,057 A 2/1995 Marnell, II
5,393,061 A 2/1995 Manship et al.
5,395,111 A 3/1995 Inoue
5,411,257 A 5/1995 Fulton
5,413,342 A 5/1995 Kaplan
5,423,539 A 6/1995 Nagao
5,429,361 A 7/1995 Raven et al.
5,431,408 A 7/1995 Adams
5,449,173 A 9/1995 Thomas et al.
5,511,781 A 4/1996 Wood et al.
5,511,784 A 4/1996 Furry et al.
5,524,888 A 6/1996 Heidel
5,542,669 A 8/1996 Charron et al.
5,560,603 A 10/1996 Seelig et al.
5,569,084 A 10/1996 Nicastro et al.
5,580,053 A 12/1996 Crouch
5,580,055 A 12/1996 Hagiwara
5,584,763 A 12/1996 Kelly et al.
5,584,764 A 12/1996 Inoue
5,609,524 A 3/1997 Inoue
5,611,535 A 3/1997 Tiberio
5,633,993 A 5/1997 Redmann et al.
5,647,798 A 7/1997 Falciglia
5,664,998 A 9/1997 Seelig et al.
5,695,188 A 12/1997 Ishibashi
5,697,843 A 12/1997 Manship et al.
5,704,835 A 1/1998 Dietz, II
5,720,662 A 2/1998 Holmes, Jr. et al.
D392,340 S 3/1998 DeSimone
5,722,891 A 3/1998 Inoue
5,752,881 A 5/1998 Inoue
5,766,074 A 6/1998 Cannon et al.
5,769,716 A 6/1998 Saffari et al.
5,772,506 A 6/1998 Marks et al.
5,772,509 A 6/1998 Weiss
5,775,692 A 7/1998 Watts et al.
5,788,573 A 8/1998 Baerlocher et al.
5,807,172 A 9/1998 Piechowiak
5,807,177 A 9/1998 Takemoto et al.
5,810,361 A 9/1998 Kadlic
5,816,915 A 10/1998 Kadlic
5,820,460 A 10/1998 Fulton
5,823,534 A 10/1998 Banyai
5,823,872 A 10/1998 Prather et al.
5,823,873 A 10/1998 Moody
5,823,874 A 10/1998 Adams
D400,597 S 11/1998 Hedrick et al.
5,833,536 A 11/1998 Davids et al.
5,833,537 A 11/1998 Barrie
D402,702 S 12/1998 Seelig et al.
5,848,932 A 12/1998 Adams
5,851,148 A 12/1998 Brune et al.
D404,084 S 1/1999 Hedrick et al.
5,855,515 A 1/1999 Pease et al.
5,863,249 A 1/1999 Inoue
5,868,618 A 2/1999 Netley et al.
5,868,619 A 2/1999 Wood et al.
D406,615 S 3/1999 Griswold et al.
D406,864 S 3/1999 Pagel
5,876,284 A 3/1999 Acres et al.
5,882,105 A 3/1999 Barlow
5,882,259 A 3/1999 Holmes, Jr. et al.
5,882,261 A 3/1999 Adams
5,890,962 A 4/1999 Takemoto
5,902,184 A 5/1999 Bennett
5,911,418 A 6/1999 Adams
5,919,088 A 7/1999 Weiss
5,927,714 A 7/1999 Kaplan
5,934,672 A 8/1999 Sines et al.
5,935,002 A 8/1999 Falciglia
5,944,315 A 8/1999 Mostashari
5,947,820 A 9/1999 Morro et al.
5,951,397 A 9/1999 Dickinson
5,957,774 A 9/1999 Holmes, Jr. et al.
5,967,518 A 10/1999 Rowe
5,971,849 A * 10/1999 Falciglia ..... 463/16
D416,054 S 11/1999 McGahn et al.
5,976,015 A 11/1999 Seelig et al.
5,976,016 A 11/1999 Moody et al.
5,980,384 A 11/1999 Barrie
5,984,781 A 11/1999 Sunaga
5,984,782 A 11/1999 Inoue
5,997,400 A 12/1999 Seelig et al.
5,997,401 A 12/1999 Crawford
6,003,867 A 12/1999 Rodesch et al.
6,004,207 A 12/1999 Wilson, Jr. et al.
6,004,208 A 12/1999 Takemoto et al.
6,015,346 A 1/2000 Bennett
6,027,115 A 2/2000 Griswold et al.
6,033,307 A 3/2000 Vancura
6,048,269 A 4/2000 Burns et al.
6,053,813 A * 4/2000 Mathis ..... 463/26

6,056,642 A 5/2000 Bennett
6,059,289 A 5/2000 Vancura
6,059,658 A 5/2000 Mangano et al.
6,062,980 A 5/2000 Luciano
6,068,552 A 5/2000 Walker et al.
6,071,192 A 6/2000 Weiss
6,086,066 A 7/2000 Takeuchi et al.
6,089,976 A 7/2000 Schneider et al.
6,089,977 A 7/2000 Bennett
6,089,978 A 7/2000 Adams
6,093,102 A 7/2000 Bennett
6,095,921 A 8/2000 Walker et al. ..... 463/20
6,102,798 A 8/2000 Bennett
6,105,962 A 8/2000 Malavozos et al. ..... 273/143 R
6,113,098 A 9/2000 Adams
6,120,031 A 9/2000 Adams
6,120,377 A 9/2000 McGinnis, Sr. et al.
6,120,378 A 9/2000 Moody
6,123,333 A 9/2000 McGinnis, Sr. et al.
6,126,165 A 10/2000 Sakamoto
6,126,542 A 10/2000 Fier
6,135,884 A 10/2000 Hedrick et al.
6,142,872 A 11/2000 Walker et al.
6,142,873 A 11/2000 Weiss et al.
6,142,874 A 11/2000 Kodachi et al.
6,142,875 A 11/2000 Kodachi et al.
6,146,273 A 11/2000 Olsen
6,149,521 A 11/2000 Sanduski
6,155,925 A 12/2000 Giobbi et al.
6,159,095 A 12/2000 Frohm et al.
6,159,096 A 12/2000 Yoseloff
6,159,097 A 12/2000 Gura
6,159,098 A 12/2000 Slomiany et al.
6,162,121 A 12/2000 Morro et al.
6,165,070 A 12/2000 Nolte et al.
6,168,520 B1 1/2001 Baerlocher et al.
6,168,523 B1 1/2001 Piechowiak et al. ..... 463/26
6,173,955 B1 1/2001 Perrie et al.
6,174,233 B1 1/2001 Sunaga et al.
6,174,234 B1 1/2001 Seibert et al.
6,174,235 B1 1/2001 Walker et al.
6,186,894 B1 2/2001 Mayeroff
6,190,254 B1 2/2001 Bennett
6,190,255 B1 2/2001 Thomas et al.
6,200,217 B1 3/2001 Osawa
6,203,429 B1 3/2001 Demar et al.
6,203,430 B1 3/2001 Walker et al.
D441,031 S 4/2001 Seelig et al.
6,210,279 B1 4/2001 Dickinson
6,213,875 B1 4/2001 Suzuki
6,213,876 B1 4/2001 Moore, Jr.
6,220,593 B1 4/2001 Pierce et al.
6,220,959 B1 4/2001 Holmes, Jr. et al.
6,224,482 B1 5/2001 Bennett
6,224,483 B1 5/2001 Mayeroff
6,227,970 B1 5/2001 Shimizu et al.
6,227,971 B1 5/2001 Weiss
6,231,442 B1 5/2001 Mayeroff
6,231,445 B1 5/2001 Acres
6,234,897 B1 5/2001 Frohm et al.
D443,313 S 6/2001 Brettschneider
6,241,607 B1 6/2001 Payne et al.
6,251,013 B1 6/2001 Bennett
6,254,481 B1 7/2001 Jaffe
6,261,177 B1 7/2001 Bennett
6,261,178 B1 * 7/2001 Bennett ..... 463/20
6,267,669 B1 7/2001 Luciano, Jr. et al.
6,270,409 B1 8/2001 Shuster
6,270,411 B1 8/2001 Gura et al.
6,270,412 B1 8/2001 Crawford et al.
6,279,902 B1 8/2001 Yamazaki et al.
6,290,600 B1 9/2001 Glasson
6,299,165 B1 10/2001 Nagano
6,299,170 B1 10/2001 Yoseloff
6,302,398 B1 10/2001 Vecchio
6,302,790 B1 10/2001 Brossard
6,305,686 B1 10/2001 Perrie et al.
6,309,299 B1 10/2001 Weiss
6,309,300 B1 10/2001 Glavich
6,309,301 B1 10/2001 Sano
6,311,976 B1 * 11/2001 Yoseloff et al. ..... 273/138.2
6,312,334 B1 11/2001 Yoseloff
6,315,660 B1 11/2001 DeMar et al.
6,315,663 B1 11/2001 Sakamoto
6,315,664 B1 11/2001 Baerlocher et al.
6,316,663 B1 11/2001 Guram et al.
6,319,124 B1 11/2001 Baerlocher et al.
6,322,078 B1 11/2001 Adams
6,322,445 B1 * 11/2001 Miller ..... 463/13
6,328,649 B1 12/2001 Randall et al.
6,334,814 B1 1/2002 Adams
6,336,860 B1 1/2002 Webb
6,336,863 B1 1/2002 Baerlocher et al.
6,340,158 B2 1/2002 Pierce et al.
6,346,043 B1 2/2002 Colin et al.
6,347,996 B1 2/2002 Gilmore et al.
6,358,144 B1 3/2002 Kadlic et al.
6,358,147 B1 3/2002 Jaffe et al.
6,364,314 B1 4/2002 Canterbury
6,364,766 B1 4/2002 Anderson et al.
6,368,216 B1 4/2002 Hedrick et al.
6,375,570 B1 4/2002 Poole
6,386,974 B1 5/2002 Adams
6,386,975 B1 5/2002 Peterson
6,394,902 B1 5/2002 Glavich et al.
6,398,218 B1 6/2002 Vancura
6,398,220 B1 6/2002 Inoue
6,398,645 B1 * 6/2002 Yoseloff ..... 463/19
6,411,276 B1 6/2002 Braun et al.
6,413,162 B1 7/2002 Baerlocher et al.
6,419,579 B1 7/2002 Bennett
6,435,511 B1 8/2002 Vancura et al.
6,439,943 B1 8/2002 Aoki et al.
6,439,993 B1 8/2002 O'Halloran
6,439,995 B1 8/2002 Hughs-Baird et al.
6,443,456 B1 9/2002 Gajor
6,454,266 B1 9/2002 Breeding et al.
6,461,241 B1 * 10/2002 Webb et al. ..... 463/20
6,464,581 B1 10/2002 Yoseloff et al.
6,471,208 B2 10/2002 Yoseloff et al.
D465,531 S 11/2002 Luciano, Jr. et al.
6,481,713 B2 11/2002 Perrie et al.
6,491,584 B2 12/2002 Graham et al.
6,494,454 B2 12/2002 Adams
6,517,432 B1 2/2003 Jaffe
6,533,273 B2 3/2003 Cole et al.
6,533,660 B2 3/2003 Seelig et al.
6,537,150 B1 3/2003 Luciano et al.
6,537,152 B2 3/2003 Seelig et al.
6,544,120 B2 4/2003 Ainsworth
6,547,242 B1 4/2003 Sugiyama et al.
6,551,187 B1 4/2003 Jaffe
6,558,254 B2 5/2003 Baerlocher et al.
6,561,900 B1 5/2003 Baerlocher et al.
6,569,015 B1 5/2003 Baerlocher et al.
6,572,473 B1 6/2003 Baerlocher
6,575,830 B2 6/2003 Baerlocher et al.
6,581,115 B1 6/2003 Arimilli et al. ..... 710/107
6,582,307 B2 6/2003 Webb
6,585,587 B2 * 7/2003 Falciglia, Sr. ..... 463/13
6,589,114 B2 7/2003 Rose
6,595,854 B2 7/2003 Hughs-Baird et al.
6,598,877 B1 7/2003 Luciano et al. ..... 273/14 R
6,599,193 B2 7/2003 Baerlocher et al. ..... 463/27
6,602,137 B2 8/2003 Kaminkow et al.
6,604,740 B1 * 8/2003 Singer et al. ..... 273/292

6,604,999 B2 8/2003 Ainsworth
6,605,001 B1 * 8/2003 Tarantino ..... 463/22
6,605,002 B2 8/2003 Baerlocher
6,609,971 B2 8/2003 Vancura
6,609,972 B2 8/2003 Seelig et al.
6,612,574 B1 9/2003 Cole et al.
6,612,575 B1 9/2003 Cole et al.
6,616,142 B2 9/2003 Adams
6,632,139 B1 10/2003 Baerlocher
6,632,140 B2 * 10/2003 Berman et al. ..... 463/18
6,634,945 B2 10/2003 Glavich et al.
6,638,167 B1 10/2003 Sawyer et al.
6,644,664 B2 11/2003 Muir et al.
6,659,864 B2 12/2003 McGahn et al.
6,676,511 B2 1/2004 Payne et al.
6,676,512 B2 1/2004 Fong et al.
6,695,696 B1 2/2004 Kaminkow
D487,582 S 3/2004 McGahn et al.
6,702,671 B2 3/2004 Tarantino
6,712,694 B1 3/2004 Nordman ..... 463/20
6,715,756 B2 4/2004 Inoue
6,726,204 B2 4/2004 Inoue
6,746,329 B1 * 6/2004 Duhamel ..... 463/20
6,780,111 B2 8/2004 Cannon et al.
6,790,141 B2 9/2004 Muir
6,793,578 B2 9/2004 Luccesi et al.
D496,968 S 10/2004 Baerlocher
6,832,957 B2 12/2004 Falconer
6,848,993 B2 * 2/2005 Webb ..... 463/22
6,854,732 B2 2/2005 Moody
6,855,056 B2 2/2005 Inoue
6,857,958 B2 2/2005 Osawa
6,864,357 B2 3/2005 Eggen et al.
6,866,585 B2 3/2005 Muir
6,869,357 B2 3/2005 Adams et al.
D504,473 S 4/2005 Baerlocher
6,875,107 B1 4/2005 Luciano, Jr.
6,880,826 B2 4/2005 Inoue
6,890,254 B2 5/2005 Kaminkow
6,893,018 B2 5/2005 Inoue
6,896,615 B2 5/2005 Berman
6,896,617 B2 5/2005 Daly
6,905,405 B2 6/2005 McClintic
6,905,406 B2 6/2005 Kaminkow et al.
6,918,830 B2 7/2005 Baerlocher
6,932,700 B2 * 8/2005 Bennett et al. ..... 463/20
6,939,226 B1 9/2005 Joshi
6,960,133 B1 11/2005 Marks et al.
6,966,835 B2 11/2005 Graham
6,974,385 B2 12/2005 Joshi et al.
6,994,625 B2 * 2/2006 Falciglia, Sr. ..... 463/20
7,001,274 B2 2/2006 Baerlocher et al.
7,007,953 B1 3/2006 Calbot
7,014,559 B1 * 3/2006 Fong ..... 463/20
7,014,560 B2 3/2006 Glavich et al.
7,029,395 B1 4/2006 Baerlocher
7,052,395 B2 5/2006 Glavich et al.
7,070,502 B1 7/2006 Bussick et al.
7,128,647 B2 10/2006 Muir
7,156,736 B2 1/2007 Adams et al.
7,160,188 B2 1/2007 Kaminkow et al.
7,161,589 B2 1/2007 Muir
7,169,042 B2 1/2007 Muir et al.
7,192,345 B2 3/2007 Muir et al.
7,309,281 B2 12/2007 Baerlocher et al.
7,309,282 B2 12/2007 Baerlocher et al.
7,329,180 B2 * 2/2008 Strom ..... 463/20
2001/0024971 A1 9/2001 Brossard
2001/0041610 A1 11/2001 Luciano et al.
2001/0054794 A1 12/2001 Cole et al.
2002/0014740 A1 2/2002 Ainsworth
2002/0025844 A1 2/2002 Casey et al.
2002/0055382 A1 5/2002 Meyer
2002/0065124 A1 5/2002 Ainsworth
2002/0090990 A1 7/2002 Joshi et al.
2002/0094857 A1 7/2002 Meyer
2002/0094862 A1 7/2002 Inoue
2002/0142829 A1 10/2002 Inoue
2002/0193158 A1 12/2002 Weiss et al.
2002/0193160 A1 12/2002 Tarantino
2003/0013518 A1 1/2003 Graham
2003/0014219 A1 1/2003 Shimizu et al.
2003/0017865 A1 1/2003 Beaulieu et al.
2003/0017868 A1 1/2003 Crawford
2003/0027622 A1 2/2003 Osawa
2003/0040355 A1 2/2003 Baerlocher
2003/0045345 A1 3/2003 Berman ..... 463/20
2003/0054874 A1 * 3/2003 Kaminkow ..... 463/20
2003/0060266 A1 3/2003 Baerlocher
2003/0064807 A1 4/2003 Walker et al.
2003/0069068 A1 4/2003 Kaminkow
2003/0083121 A1 5/2003 Cole et al.
2003/0092480 A1 5/2003 White et al.
2003/0114215 A1 * 6/2003 Adams et al. ..... 463/20
2003/0114218 A1 6/2003 McClintic
2003/0119581 A1 6/2003 Cannon et al.
2003/0144053 A1 7/2003 Michaelson
2003/0181231 A1 9/2003 Vancura et al. ..... 463/9
2003/0181239 A1 * 9/2003 Walker et al. ..... 463/20
2003/0203752 A1 10/2003 Kaminkow et al.
2003/0216165 A1 11/2003 Singer et al.
2003/0216166 A1 11/2003 Baerlocher et al. ..... 463/20
2003/0220134 A1 11/2003 Walker et al. ..... 463/20
2003/0232643 A1 12/2003 Inoue
2003/0236116 A1 12/2003 Marks et al. ..... 463/16
2004/0000754 A1 1/2004 Inoue
2004/0009803 A1 1/2004 Bennett et al.
2004/0012145 A1 1/2004 Inoue
2004/0014516 A1 1/2004 Inoue
2004/0014517 A1 1/2004 Inoue
2004/0017041 A1 1/2004 Inoue
2004/0018866 A1 1/2004 Inoue
2004/0023714 A1 2/2004 Asdale
2004/0026854 A1 2/2004 Inoue
2004/0036218 A1 2/2004 Inoue
2004/0038726 A1 2/2004 Inoue
2004/0041340 A1 3/2004 Inoue
2004/0048650 A1 3/2004 Mierau et al.
2004/0053658 A1 3/2004 Rothranz
2004/0053665 A1 3/2004 Baerlocher
2004/0053687 A1 3/2004 Nordman et al. ..... 463/30
2004/0058727 A1 3/2004 Marks et al.
2004/0077401 A1 4/2004 Schlottmann
2004/0077402 A1 4/2004 Schlottmann
2004/0082373 A1 4/2004 Cole et al.
2004/0097280 A1 5/2004 Gauselmann
2004/0121840 A1 6/2004 Rosander et al.
2004/0155399 A1 8/2004 Inoue
2004/0157659 A1 8/2004 Fox ..... 463/20
2004/0171417 A1 9/2004 Beaulieu et al. ..... 463/20
2004/0180716 A1 9/2004 Seelig et al. ..... 463/20
2004/0183251 A1 9/2004 Inoue
2004/0192431 A1 9/2004 Singer et al.
2004/0195773 A1 10/2004 Musci et al.
2004/0214630 A1 10/2004 Mayeroff
2004/0219968 A1 11/2004 Fiden et al.
2004/0242313 A1 12/2004 Munoz
2004/0242314 A1 12/2004 Casey
2005/0020348 A1 1/2005 Thomas et al.
2005/0043083 A1 2/2005 Inoue
2005/0043084 A1 2/2005 Inoue
2005/0054411 A1 * 3/2005 Hughs-Baird et al. ..... 463/16
2005/0054419 A1 * 3/2005 Souza et al. ..... 463/20
2005/0054421 A1 * 3/2005 Hughs-Baird et al. ..... 463/20
2005/0054424 A1 3/2005 Rothkranz et al.
2005/0054429 A1 3/2005 Baerlocher et al.

| | | | | |
|---|---|---|---|---|
| 2005/0054435 | A1 | 3/2005 | Rodgers et al. | |
| 2005/0059477 | A1 | 3/2005 | Baerlocher | |
| 2005/0059478 | A1 | 3/2005 | Peterson et al. | |
| 2005/0059481 | A1 | 3/2005 | Joshi et al. | |
| 2005/0060050 | A1 | 3/2005 | Baerlocher | |
| 2005/0096123 | A1 | 5/2005 | Cregan et al. | |
| 2005/0124404 | A1 | 6/2005 | Nicely | |
| 2005/0124406 | A1 | 6/2005 | Cannon | |
| 2005/0130731 | A1 | 6/2005 | Englman et al. | |
| 2005/0130737 | A1 | 6/2005 | Englman et al. | |
| 2005/0148384 | A1 | 7/2005 | Marks et al. | |
| 2005/0170876 | A1 | 8/2005 | Masci et al. | |
| 2005/0181853 | A1 | 8/2005 | Baerlocher | |
| 2005/0187011 | A1 | 8/2005 | Kaminkow | |
| 2005/0192081 | A1 | 9/2005 | Marks et al. | |
| 2005/0208994 | A1 | 9/2005 | Berman | |
| 2005/0277460 | A1 | 12/2005 | Inoue | |
| 2005/0282620 | A1 | 12/2005 | Marks et al. | |
| 2005/0288094 | A1 | 12/2005 | Marks et al. | |
| 2006/0019738 | A1 | 1/2006 | Baerlocher et al. | |
| 2006/0040728 | A1 | 2/2006 | Fuller | |
| 2006/0046830 | A1 | 3/2006 | Webb | |
| 2006/0068875 | A1* | 3/2006 | Cregan et al. | 463/16 |
| 2006/0073872 | A1 | 4/2006 | B-Jensen et al. | |
| 2006/0073873 | A1* | 4/2006 | Rodgers et al. | 463/20 |
| 2006/0084492 | A1 | 4/2006 | Baerlocher et al. | |
| 2006/0084493 | A1 | 4/2006 | Pederson et al. | |
| 2006/0084497 | A1 | 4/2006 | Marks et al. | |
| 2006/0089191 | A1 | 4/2006 | Singer et al. | |
| 2006/0111173 | A1 | 5/2006 | Yang | |
| 2006/0111174 | A1 | 5/2006 | Baerlocher et al. | |
| 2006/0116195 | A1 | 6/2006 | Baerlocher et al. | |
| 2006/0121969 | A1 | 6/2006 | Marks et al. | |
| 2006/0135247 | A1 | 6/2006 | Baerlocher et al. | |
| 2006/0183535 | A1 | 8/2006 | Marks et al. | |
| 2006/0246977 | A1 | 11/2006 | Cannon | |
| 2007/0026923 | A1 | 2/2007 | Muir | |
| 2007/0054726 | A1 | 3/2007 | Muir | |
| 2007/0060255 | A1 | 3/2007 | Baerlocher et al. | |
| 2007/0077980 | A1 | 4/2007 | Marks et al. | |
| 2007/0111782 | A1 | 5/2007 | Adams et al. | |
| 2007/0129134 | A1 | 6/2007 | Barrie | |
| 2008/0096670 | A1 | 4/2008 | Baerlocher et al. | |

FOREIGN PATENT DOCUMENTS

| | | |
|---|---|---|
| AU | 199650720 | 10/1996 |
| AU | 199716432 | 9/1997 |
| AU | 199717601 | 9/1997 |
| AU | A-50327/96 | 10/1997 |
| AU | 199747657 | 6/1998 |
| AU | 199917318 | 9/1999 |
| AU | 200179411 | 4/2002 |
| AU | 2002330133 | 4/2003 |
| AU | 2006201732 | 11/2006 |
| CA | 2461640 | 3/2003 |
| DE | 31 05 266 | 9/1982 |
| DE | 37 00 861 | 7/1988 |
| DE | 42 26 873 | 11/1990 |
| EP | GB 912 685 | 12/1962 |
| EP | 0 060 019 | 9/1982 |
| EP | 0 238 289 | 9/1987 |
| EP | 0 410 789 | 7/1990 |
| EP | 0 798 676 | 10/1997 |
| EP | 0 840 256 | 5/1998 |
| EP | 0 926 645 | 6/1999 |
| EP | 0 944 030 | 9/1999 |
| EP | 0 945 837 | 9/1999 |
| EP | 0 984 408 | 3/2000 |
| EP | 1 003 138 | 5/2000 |
| EP | 1 054 368 | 11/2000 |
| EP | 1 082 979 | 3/2001 |
| EP | 1 083 531 | 3/2001 |
| EP | 1 205 894 | 10/2001 |
| EP | 1 184 822 | 3/2002 |
| EP | 1199688 | 4/2002 |
| EP | 1 296 296 | 3/2003 |
| GB | 1 464 896 | 1/1974 |
| GB | 2 083 936 | 3/1982 |
| GB | 2 090 690 | 7/1982 |
| GB | 2 096 376 | 10/1982 |
| GB | 2 097 160 | 10/1982 |
| GB | 2 100 905 | 1/1983 |
| GB | 2 101 380 | 1/1983 |
| GB | 2 105 891 | 3/1983 |
| GB | 2 106 292 | 4/1983 |
| GB | 2 117 155 | 10/1983 |
| GB | 2 137 392 | 10/1984 |
| GB | 2 161 008 | 1/1986 |
| GB | 2 170 636 | 8/1986 |
| GB | 2 170 643 | 8/1986 |
| GB | 2 180 087 | 3/1987 |
| GB | 2 181 589 | 4/1987 |
| GB | 2 183 882 | 6/1987 |
| GB | 2 191 030 | 12/1987 |
| GB | 2 201 821 | 9/1988 |
| GB | 2 222 712 | 3/1990 |
| GB | 2 225 889 | 6/1990 |
| GB | 2 226 436 | 6/1990 |
| GB | 2 226 907 | 7/1990 |
| GB | 2 242 300 | 9/1991 |
| GB | 2 262 642 | 6/1993 |
| GB | 2 193 441 | 2/1998 |
| GB | 2 316 214 | 2/1998 |
| GB | 2 328 311 | 2/1999 |
| GB | 2 393 019 | 3/2004 |
| GB | 2 402 256 | 12/2004 |
| JP | 408 010 383 | 1/1996 |
| JP | 410 328 351 | 12/1998 |
| JP | 2001017657 | 1/2001 |
| WO | WO 96/08799 | 3/1996 |
| WO | WO 97/32285 | 9/1997 |
| WO | WO 98/00207 | 1/1998 |
| WO | WO 99/10849 | 3/1999 |
| WO | WO 00/20082 | 4/2000 |
| WO | WO 00/59591 | 10/2000 |
| WO | WO 00/66235 | 11/2000 |
| WO | WO 00/76606 | 12/2000 |
| WO | WO 01/19476 | 3/2001 |
| WO | WO 01/71678 | 9/2001 |
| WO | WO 01/74464 | 10/2001 |
| WO | WO 01/87441 | 11/2001 |
| WO | WO 03/049055 | 3/2003 |
| WO | WO 03/026758 | 4/2003 |
| WO | WO 2004/025584 | 3/2004 |
| WO | WO 2005/010831 | 6/2004 |
| WO | WO 2004/082779 | 9/2004 |
| WO | WO 2005/009560 | 2/2005 |
| WO | WO 2005/058444 | 6/2005 |

OTHER PUBLICATIONS

3 Way-Action Poker Advertisement, written by IGT, published prior to Feb. 11, 2005.

3 Way-Action Poker Website, written by IGT, printed Mar. 21, 2001.

American Bandstand Brochure, written by Anchor Games, published in 2001.

Arcade-History.com listing of Aristocrat gaming device with release dates, printed in Feb. 2006, available prior to Feb. 11, 2005.

Austin Powers in Goldmember™ Advertisement, written by IGT, published in 2003.

Aztec Temple Advertisement, written by IGT, published in 2005.

Aztec Temple MultiWay Article, written by Strictly Slots, published in Aug. 2005.

Barn Yard Article, written by Strictly Slots, published in Mar. 2002.

Barn Yard Advertisement written by Aristocrat, published prior to Feb. 11, 2005.
Black Rhino Game Description, printed from Arcade-History.com in Feb. 2006, available prior to Feb. 11, 2005.
Big Shot!™ Advertisement, written by Aristocrat Technologies, Inc., published in 2002.
Bonus Line Lightning Advertisement, written by Bally Gaming, published in 2006.
Bonus Roulette Brochure, written by R. Franco, published prior to Feb. 11, 2005.
Bonus Times Article, written by Strictly Slots, published in Jul. 2000.
Boot Scootin Article, written by Strictly Slots, published in Apr. 2001.
Buck's Roulette Brochure, written by R. Franco, published prior to Feb. 11, 2005.
Break the Spell Advertisement, written by Atronic, published in 1999.
Carnival of Mystery Advertisement, written by IGT, published in 2005.
Catch A Wave Advertisement, written by IGT, published in Dec. 2001.
Chariot's Fortune Brochure, written by R. Franco, published prior to Feb. 11, 2005.
Classic Pot of Gold Brochure, written by Ace Coin Equipment Ltd., published prior to Feb. 11, 2005.
Cossack Dance Advertisement, written by Olympic Video Gaming, published prior to Feb. 11, 2005.
Description of Symbol Feature in Australian UFO Gaming Machine, published by Barcrest, Ltd., in 1995.
Dolphin Treasure Advertisement, written by Aristocrat, published in Jul. 1993.
Double Diamond Line Advertisement, written by IGT, published in 2003.
Dynamic Paytable Description, written by IGT Australia, published prior to Feb. 11, 2005.
Easy Street Advertisements and Articles, written by Casino Data Systems, published in 2000.
Elvira® Mistress of the Dark™ Advertisement, written by IGT, published in 2002.
Elvis Hits Advertisement, written by IGT, published in 1999.
Enchanted Unicorn Advertisement, written by IGT, published in 2003.
Enchanted Unicorn Advertisement, written by IGT, published in 2001.
Fey, Marshall, Slot Machines—A Pictorial History of the First 100 Years, 1997, Liberty Bell Books, 5th Ed., p. 13.
Fishin' Buddies Article, written by Strictly Slots, published in Apr. 2001.
Gold Fever Advertisement ,written by Atronic Casino Technology, Ltd., published 1999.
Golden Canaries Game Description, printed from Arcade History.com in Feb. 2006, available prior to Feb. 11, 2005.
Goooaal! Advertisement, written by Bally Gaming, Inc., published in 2000.
Happy Camper Advertisement, written by IGT, published in 2004.
Holy Smoke Brochure, written by Impulse Gaming Ltd., published prior Feb. 11, 2005.
I Love Lucy: Vitameatavegamin and I Love Lucy, Chocolate Factory IGT articles, written by Strictly Slots, published in Jan. 2003 and May 2003.
Jack and the Beanstalk™ Brochure, written by AC Coin & Slot, published prior to Feb. 11, 2005.
Jackpot Party Brochures and Articles, written by WMS Gaming, Inc., published in 1998.
Jewel in the Crown Advertisement, written by IGT, published 1999.
Joker's Wild Advertisement, written by IGT, published prior to Feb. 11, 2005.
Jolly Joker Game Specification, written by Barcrest, published in Jul. 1993.
King of the Grill™ Brochure, written by AC Coin & Slot, published prior to Feb. 11, 2005.
The Latest Buzz Article, written by Bally Gaming Systems, published in Fall 2000.
Let the Games Begin Advertisement, written by Aristocrat, published prior to Feb. 11, 2005.
Line-UP Brochure, written by AC Coin & Slot, published prior to Feb. 11, 2005.
Little Green Men Jr.™ Advertisement, written by AC Coin & Slot, published prior to Feb. 11, 2005.
Little Green Men Jr.™ Article, written by Strictly Slots, published in Feb. 2003.
Loco Loot Article, written by Strictly Slots, published in May 2002.
M-Slot Series Primary Reel Product Description from Lemons, Cherries and Bell-Fruit-Gum, written by Richard M. Bueschel, published in 1995.
Magic 8 Ball Advertisement, written by IGT, published in 2002.
Miss America Brochure, written by AC Coin & Slot, published prior to Feb. 11, 2005.
Mix and Match Advertisement, published by AC Coin & Slot, published prior to Feb. 11, 2005.
Mix and Match Article, written by Strictly Slots, published in Apr. 2002.
Money Grab Article, written by Strictly Slots, published in Apr. 2001.
Money Honey Advertisement, written by Aristocrat, published in 2004.
Monster Match Article, written by Strictly Slots, published in Jan. 2002.
Mountain Money Article, written by Strictly Slots, published in Jun. 2002.
Multi-Way Description, printed from www.igt.com/GamingGroup/Games/base.asp?pid-5.20 on Oct. 31, 2007, available prior to Feb. 11, 2005.
Multiway Wagering Advertisement, written by IGT, published prior to Feb. 11, 2005.
Munsters Article, written by Strictly slots, published in Apr. 2001.
On the Money! Article, written by Strictly Slots, published in Dec. 2000.
Penguin Pays Advertisement, written by Aristocrat, published in 1998.
Pick a Prize Brochure, written by Acres Gaming Incorporated, published prior to Feb. 11, 2005.
Pictures of various co-IGT and Aristocrat gaming devices, available prior to Feb. 11, 2005.
Power Slotto Brochure, published by AC Coin & Slot, prior to Feb. 11, 2005.
Press Your Luck Brochure, published by AC Coin & Slot, prior to Feb. 11, 2005.
Quick Pick Paytime Brochure, written by Acres Gaming Incorporated, published Feb. 11, 2005.
R&B™ Brochure, published AC Coin & Slot, published prior to Feb. 11, 2005.
Red Hot Roll Brochure and Description, written by Barcrest Ltd., published prior to Feb. 11, 2005.
Reel Dice Advertisement, written by Gerber & Glass, published in 1936.
Reel Magic™ Gaming Machine Description written by IGT, available in 1986.
Reel Power and Super Reel Power Advertisements, written by Aristocrat, published prior to Feb. 11, 2005.
Reelin-n-Rockin Advertisement, written by Aristocrat, published in 1999.
Response to Dec. 2003 Final Office Action for U.S. Published Patent Application No. 2002/0039930.
Royal Roulette Brochure, written by Impulse Gaming Ltd., published prior to Feb. 11, 2005.
Silver City Roundup Brochure, published by AC Coin & Slot, published prior to Feb. 11, 2005.
Slot Machine Buyer's Handbook, A Consumer's Guide to Slot Machines, written by David L. Saul and Daniel R. Mead, published in 1998.
Slot Machines Article, written by Reno-Tahoe Specialty, Inc., published in 1989.

* cited by examiner

GAMING MACHINE HAVING INDEPENDENT SPINNING FORMS AND MULTIPLE PAY LINES

BACKGROUND OF THE INVENTION

1. Field of the Invention

The present invention relates to the field of mechanical and/or video wagering games, including multiple pay line video slot-type machines that are capable of producing certain winning combinations including, preferably, one or more progressive jackpot amounts.

2. Background of the Art

Competition in the gaming industry to attract a player and then retain the player's interest for protracted periods of time is an increasingly greater challenge. The environment in a casino is typically rich in stimulation, both auditory and visual. Consequently, it is an ongoing effort to attract a player to a given machine and then to subsequently encourage the player to stay at the machine based on the machine's game format and entertainment value.

Slot machines formed from a plurality of independently rotating reels, whether mechanical or video depictions of the mechanical reels, are traditional types of wagering games. Each physical reel has a reel strip around its circumference, on which are designated indicia. The circular reel is presented to the player so that the indicia on the strip show through a window on the machine's front. The player receives awards when combinations of predetermined indicia, especially related indicia that are oriented on a pay line, appear as a result of the wagered spin of the reels. Some machines also provide for a large jackpot or progressive jackpot that can produce potentially life-changing awards.

Such slot machines have evolved from having a single horizontal pay line centrally disposed on the reel to having a plurality of pay lines. Some of these pay lines are located horizontally, some vertically, some diagonally, others in corners and/or non-linear patterns. The most common pay lines have been provided as a) three symbols in a linear pattern taken from sets of frames on reels having 3 columns and 3 rows, or b) subsets of 3 to 5 symbols in a row taken from a set of three rows and five columns. The 3 rows by 5 column main game configuration is most typically known as a multiline game.

Winning combinations on the traditional 3-reel machines are easily recognized, but the setup itself discourages multiple pay lines. Conversely, the 3-row×5-column configuration allows for multiple pay lines, but the winning combinations can be confusing and difficult to read. It is a challenge to provide new game play that would produce multiple wins, yet easily recognized wins. The frequency of "hits" on the traditional 3-reel machines can also be problematic. In most cases, the end result of a wagered 3-reel game is either a win worth at least the same as the wager, or a total loss of the wager, so the player may play many losing games in a row without experiencing a true winning event, increasing the total credits held by the player, or a smaller win event that reduces the rate of loss of credits. It would be desirable to have a simple-to-understand pay line system which can also provide more frequent "hits", even if these are wins that are less than the amount of wager. Smaller wins can give the player more time on the machine, which translates to more revenue for the casino. In addition, new techniques are needed to provide the player with jackpot opportunities, including multiple, varied jackpot awards.

U.S. Pat. No. 6,712,694 titled GAMING DEVICE WITH ROTATING DISPLAY AND INDICATOR THEREFORE; U.S. Pat. No. 6,599,193 titled PROGRESSIVE GAMING DEVICE; U.S. Pat. No. 6,598,877 titled SLOT MACHINE USING PERIPHERAL GEARS ENGAGED BY MULTIPLE DRIVE SYSTEMS; U.S. Pat. No. 6,168,523 titled BONUS AWARD FEATURE IN A GAMING MACHINE; U.S. Pat. No. 6,581,115 titled GAMING METHOD AND APPARATUS HAVING A PROPORTIONAL PAYOUT; U.S. Pat. No. 6,105,962 titled ROTATING DISKS SLOT MACHINE; U.S. Pat. No. 6,095,921 titled ELECTRONIC AMUSEMENT DEVICE AND METHOD FOR OPERATING A GAME OFFERING CONTINUOUS REELS; and Published U.S. Patent Applications 20030045345 titled GAMING METHOD AND APPARATUS IMPLEMENTING A HIERARCHICAL DISPLAY GRID AND DYNAMICALLY GENERATED PAYLINES; 20030181231 titled PROGRESSIVE GAMING SYSTEM AND METHOD HAVING FRACTIONAL AWARDS; 20030216166 titled METHOD OF OPERATING A PROGRESSIVE GAMING DEVICE; 20030220134 titled APPARATUS HAVING MOVABLE DISPLAY AND METHODS OF OPERATING SAME; 20030236116 titled SLOT MACHINE GAME HAVING A PLURALITY OF WAYS TO ISSUE A PERCENTAGE OF A PROGRESSIVE AWARD BASED UPON ANY WAGER LEVEL ("PERCENTAGE PROGRESSIVE"); 20040053687 titled GAMING DEVICE HAVING DISPLAY WITH MULTIPLE RADIALLY TRANSLATING INDICATORS; 20040157659 titled SLOT GAMING SYSTEM AND METHOD; 20040171417 titled METHOD AND APPARATUS FOR DISPLAYING A SYMBOL ON A WHEEL ASSOCIATED WITH A GAMING APPARATUS; and 20040180716 titled GAMING DISPLAY WITH MOVEABLE INDICATOR AND METHODS OF USE describe various formats and games played on gaming apparatus, including slot-type gaming apparatus and video gaming apparatus.

Although there are many varieties of games available, there is room for new games and games that provide additional goals desired by players and casinos.

SUMMARY OF THE INVENTION

A screen is provided on which symbols may be provided for use in a slot-type wagering game. Symbols are displayed as distinct symbol elements, such as within frames, on sectioned geometrical shapes such as triangles, hexagons, rectangles, octagons, ovals and squares, but preferably on circles, etc. Specific symbol combinations, particularly comprised of one symbol appearing on one individual section of each sectioned geometric shape or all symbols appearing on all sections of one sectioned geometric shape, may constitute a winning combination according to a predetermined pay table. An additional payline comprised of all sections on all sectioned geometric shapes may provide for larger wins, including jackpot wins and progressive jackpot wins.

DETAILED DESCRIPTION OF THE INVENTION

Figure 1:
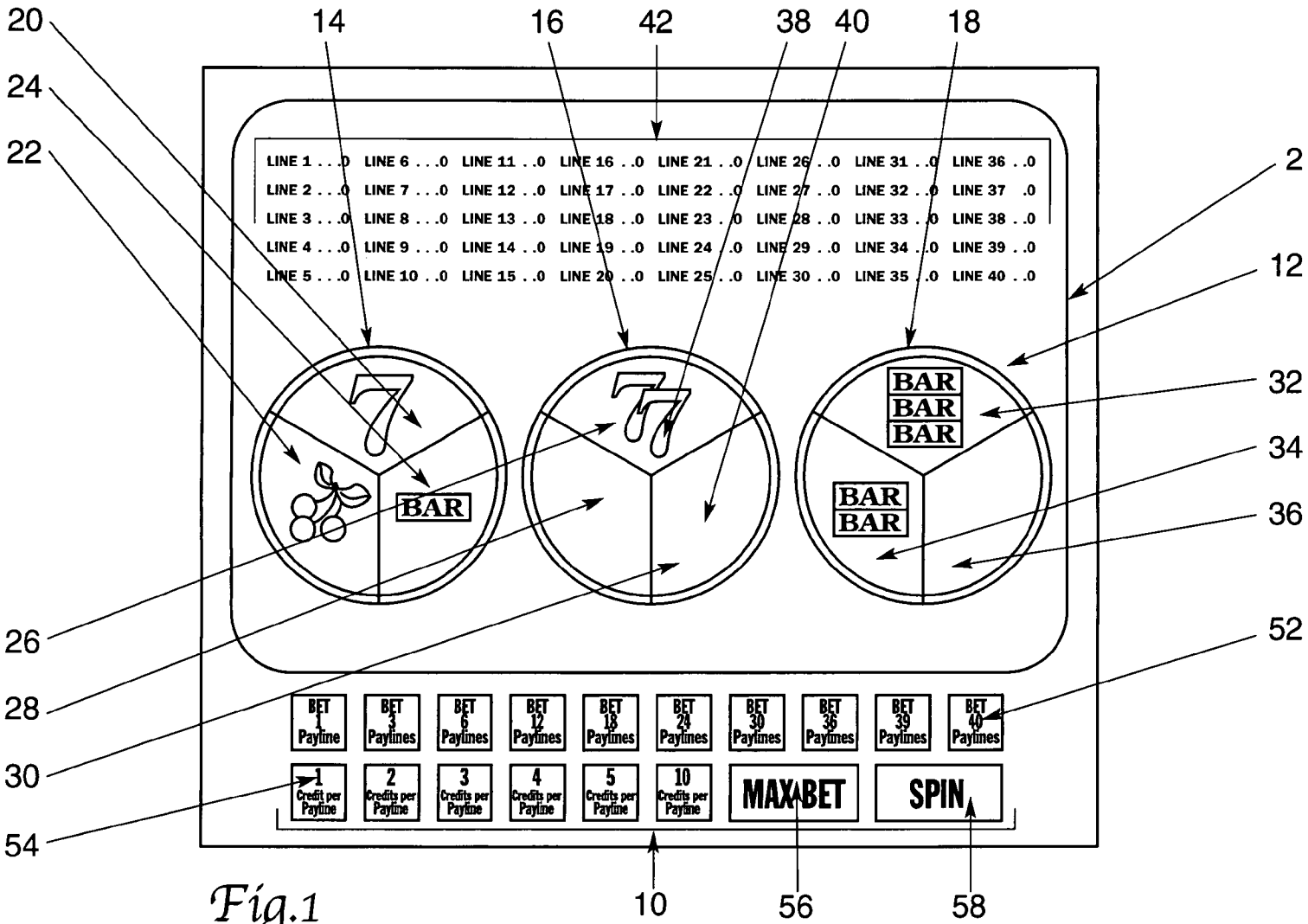
FIG. 1 illustrates one embodiment of a screen setup of a base game with segmented circles as geometric shapes according to teachings herein.

Game play described herein may be implemented on existing and commercial mechanical, virtual/mechanical or video gaming apparatus on any of the many available formats and platforms merely by insertion of a game card or game software effecting the selections and rules and payouts according to the present game. The base game may also be implemented on a stepper mechanical reel format. The game may be operated on-line, in a banked set of gaming machines or independent machines with independent processors. The game can be programmed onto MAC, PC, LINUX, open or closed operating systems (as well as other or newer commercial systems) and can be displayed with standard CRT displays, plasma displays, LCD displays, LED displays, holographic displays and the like. The games may be operated with ticket-in/ticket-out crediting, coins, tokens, currency, credit cards, or gaming accounts as well understood by one skilled in the art. The following is intended to offer a general description and example of the technology of the game play and offer insight into distinctions from existing commercial or disclosed game play.

One general description of the method of playing a wagering game on a mechanical, virtual/mechanical or video gaming apparatus as described herein is as follows. The game format of 3-section circular reels and standard game symbols, i.e., cherries, bars and 7s, will be used in the description for consistency in the analogies of the play, but the game is of course not limited to that specific imagery. Before or upon initiation of the play of a single game (by placing a wager), the system provides a display screen having an area containing three or more sectioned shapes (called reels) within which symbols can be displayed. Preferably three 3-section virtual circular reels appear in a linear fashion from left to right. The three equal sections on each reel may be color-coded for more easy comprehension of the pay lines: the top section (at 12 O'clock) may be red, the right section (at 4 O'clock) may be blue and the left section (at 8 O'clock) may be green. Also shown on the screen may be the pay lines bet by the player, in this example 1 to 40 available pay lines. The forty pay lines are described as follows: each pay line consists of three reel sections, one section on each of the reels, or three sections on any one reel. Pay lines 1, 2, and 3 consist of three sections on each single reel from left to right, respectively. Pay lines 4, 5, and 6 consist of like sections on all reels (all 3 red sections, all 3 green sections, and all 3 blue sections, respectively). Pay lines 7 through 30 consist of all other possible different combinations of one section on each of the three reels. Pay lines 31 through 36 repeat the wagers on Pay lines 1 through 6, respectively (providing larger wins on the more obvious pay lines). Pay lines 37, 38, and 39 each repeat an additional wager on Pay lines 1, 2, and 3 respectively (providing the largest wins on the most obvious pay lines). If the player has bet all 39 pay lines, an additional wager would activate Pay line 40, consisting of all 9 sections of the three reels, and paying varying bonus awards for (preferably) receiving 9 like symbols, from the lowest-paying symbol to the highest-paying symbol. Each of these bonus awards may be a Progressive Jackpot. An alternate pay line configuration may utilize the Pay lines 1 through 30 as previously described, with Pay line 31 being the bonus 9-section pay line, with no repeat pay lines as previously described.

After the wager, play is initiated by the spinning of each reel in a circular fashion with virtual symbols streaming clockwise or counter-clockwise on the reels. The spinning reels and symbols stop, preferably one reel at a time from left to right. The symbols and/or blanks displayed are evaluated for wins according to a predetermined paytable. Wins may also be highlighted in the wagered pay lines area shown on the screen.

Reference to the Figures will assist in further understanding of the practice of the present invention.

FIG. 1 shows a monitor screen 2 having a display of a base game 12 showing three separate circular reels (14, 16, 18), and each reel divided into three equal 120° sections (20, 22, 24, 26, 28, 30, 32, 34, 36). Symbols 38 or "blanks" 40 are displayed on the colored-coded sections (20, 22, 24, 26, 28, 30, 32, 34, 36). A pay line payout chart 42 is also shown on the screen 2. The player control panel 10 incorporates buttons for various player wagering options, i.e., Pay lines Wagered 52, Credits Wagered per Pay line 54, Max Bet 56 and Spin 58.

Figure 2:
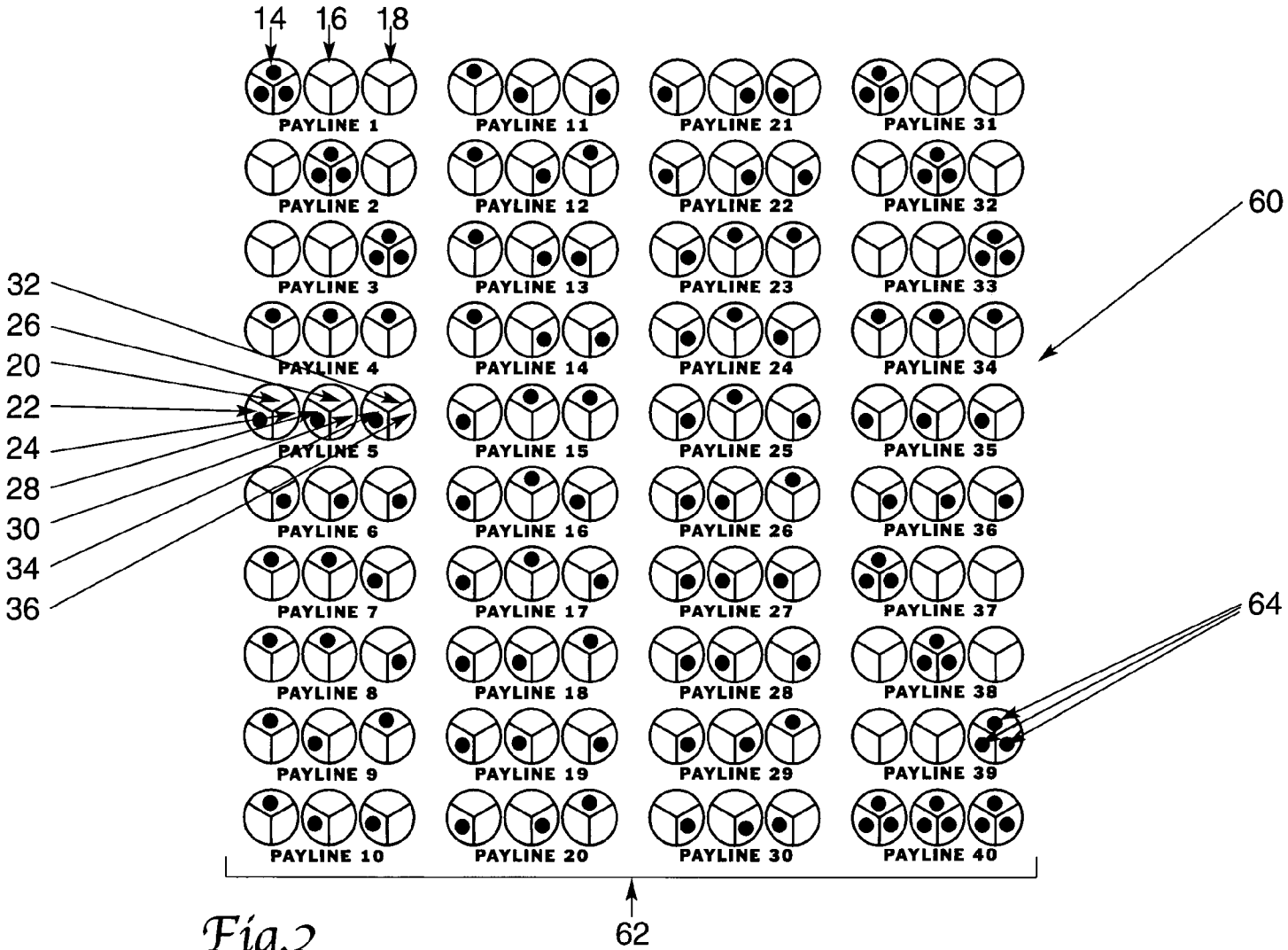
FIG. 2 illustrates one embodiment of a screen shot where 40 pay lines could be available in the play of a base game.

FIG. 2 shows a chart 60 explaining the 40 pay lines 62 available in the play of the invention. Each of the 40 pay lines 62 is displayed on a set of three separate circular reels (14, 16, 18) with each pay line consisting of three color-coded sections (20, 22, 24, 26, 28, 30, 32, 34, 36) and labeled by three bullet symbols 64 to indicate that particular pay line.

Figure 3:
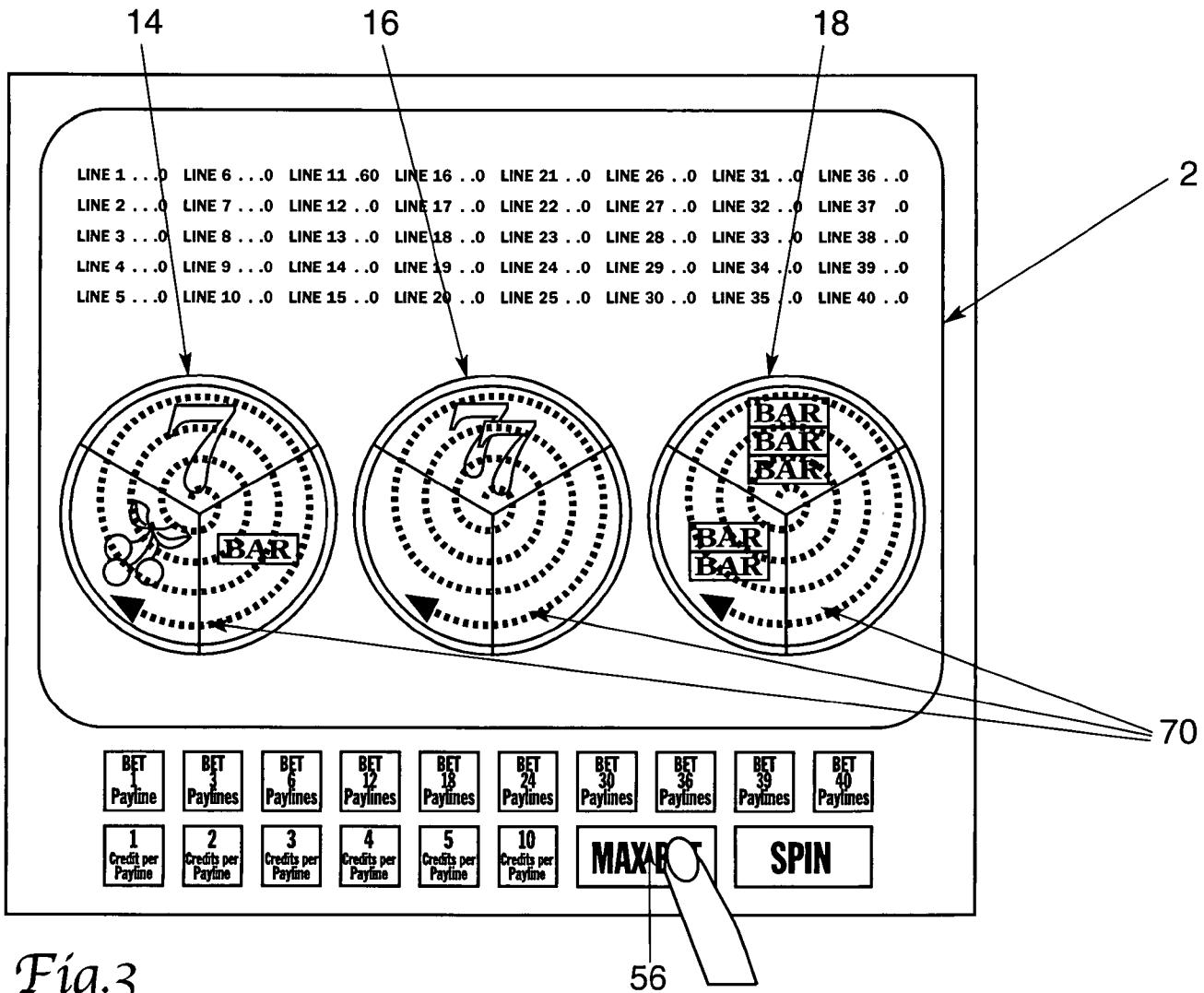
FIG. 3 shows a screen shot of one possible sample stage of a game played with segmented circles as geometric shapes according to teachings herein.

FIG. 3 shows a monitor screen 2 with the player pressing the Max Bet 56 button (a wager of 40 pay lines and 10 credits bet per line) initiating the set of three separate reels (14, 16, 18) to spin 70 in a circular fashion.

Figure 4:
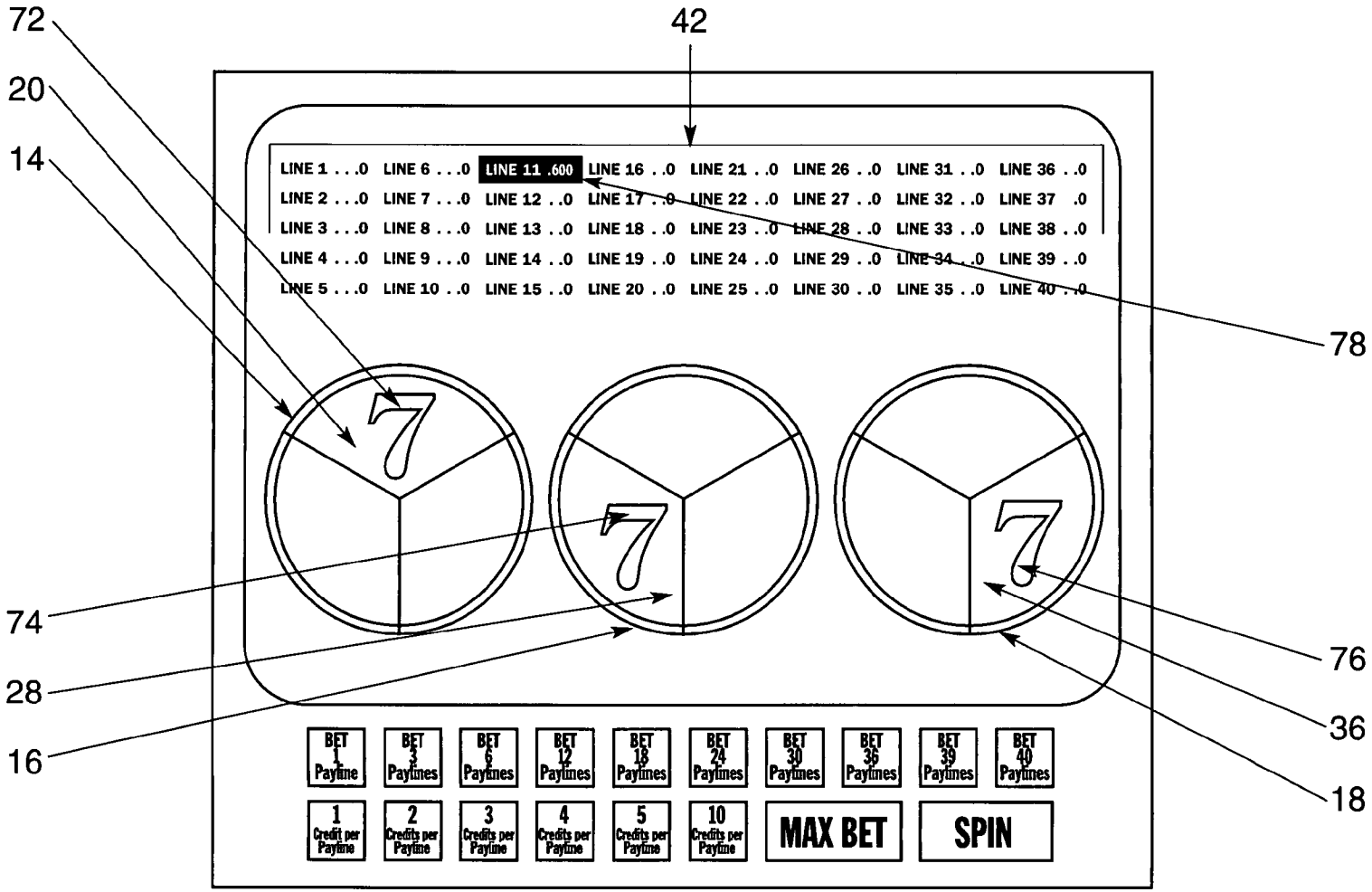
FIG. 4 shows another screen shot of one possible sample stage of a game played with segmented circles as geometric shapes according to teachings herein.

FIG. 4 shows a possible result of the reel spin 70 in FIG. 3. One Red 7 symbol 72 is present on a section 20 of the first reel 14, one Red 7 symbol 74 is present on a section 28 of the second reel 16, and one Red 7 symbol 76 is present on a section 36 of the third reel 18, indicating a Win on Payline 11 78 of the pay line explanation chart 60 in FIG. 2 and highlighted in the pay line payout chart 42.

Figure 5:
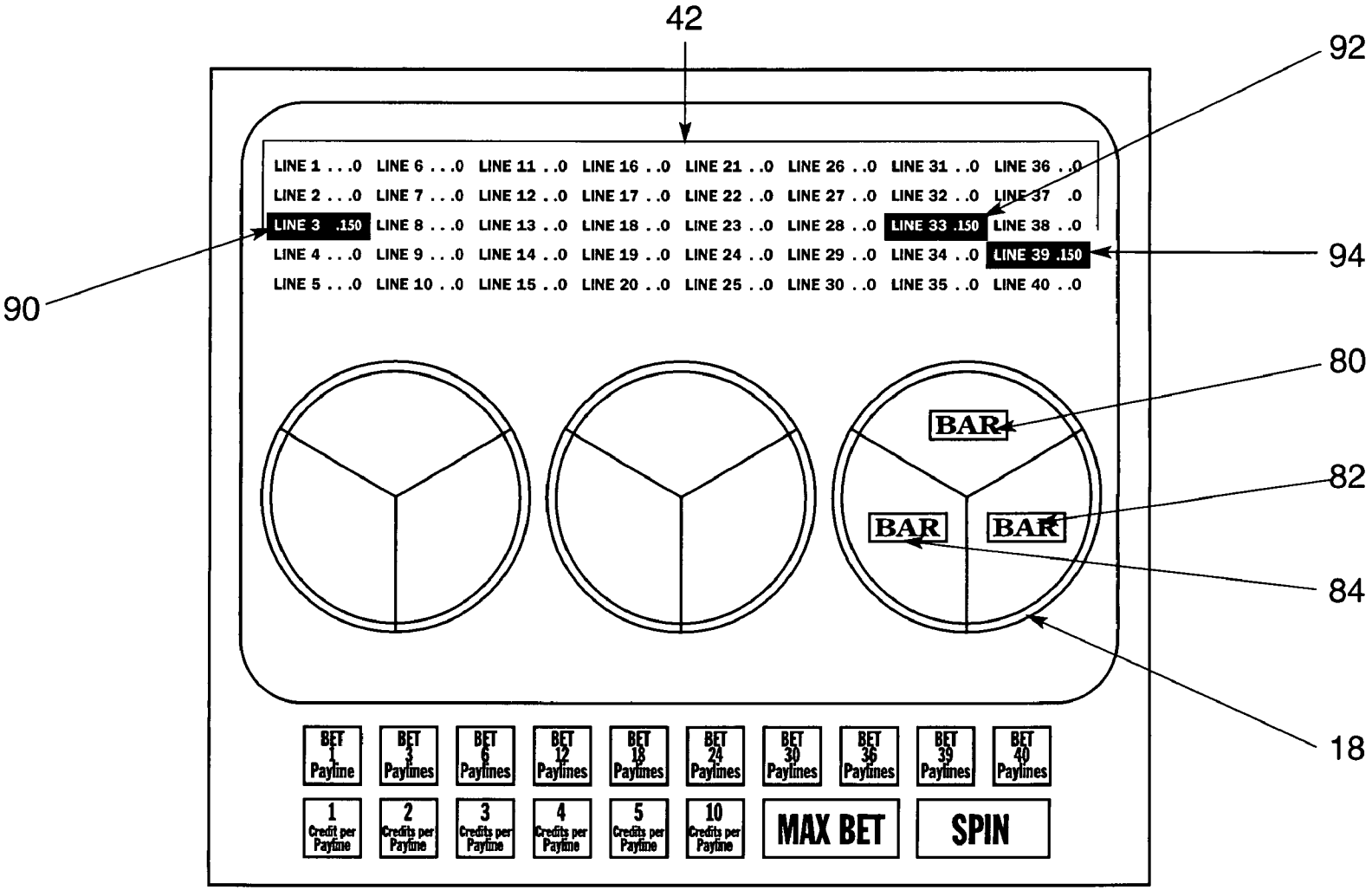
FIG. 5 shows another screen shot of one possible sample stage of a game played with segmented circles as geometric shapes according to teachings herein.

FIG. 5 shows another possible result of the reel spin 70 in FIG. 3. Three matching Bar symbols (80, 82, 84) are present on the third circular reel 18, indicating a Win on Pay lines 3 90, 33 92, and 39 94 as shown in the pay line explanation chart 60 in FIG. 2 and highlighted in the pay line payout chart 42.

Figure 6:
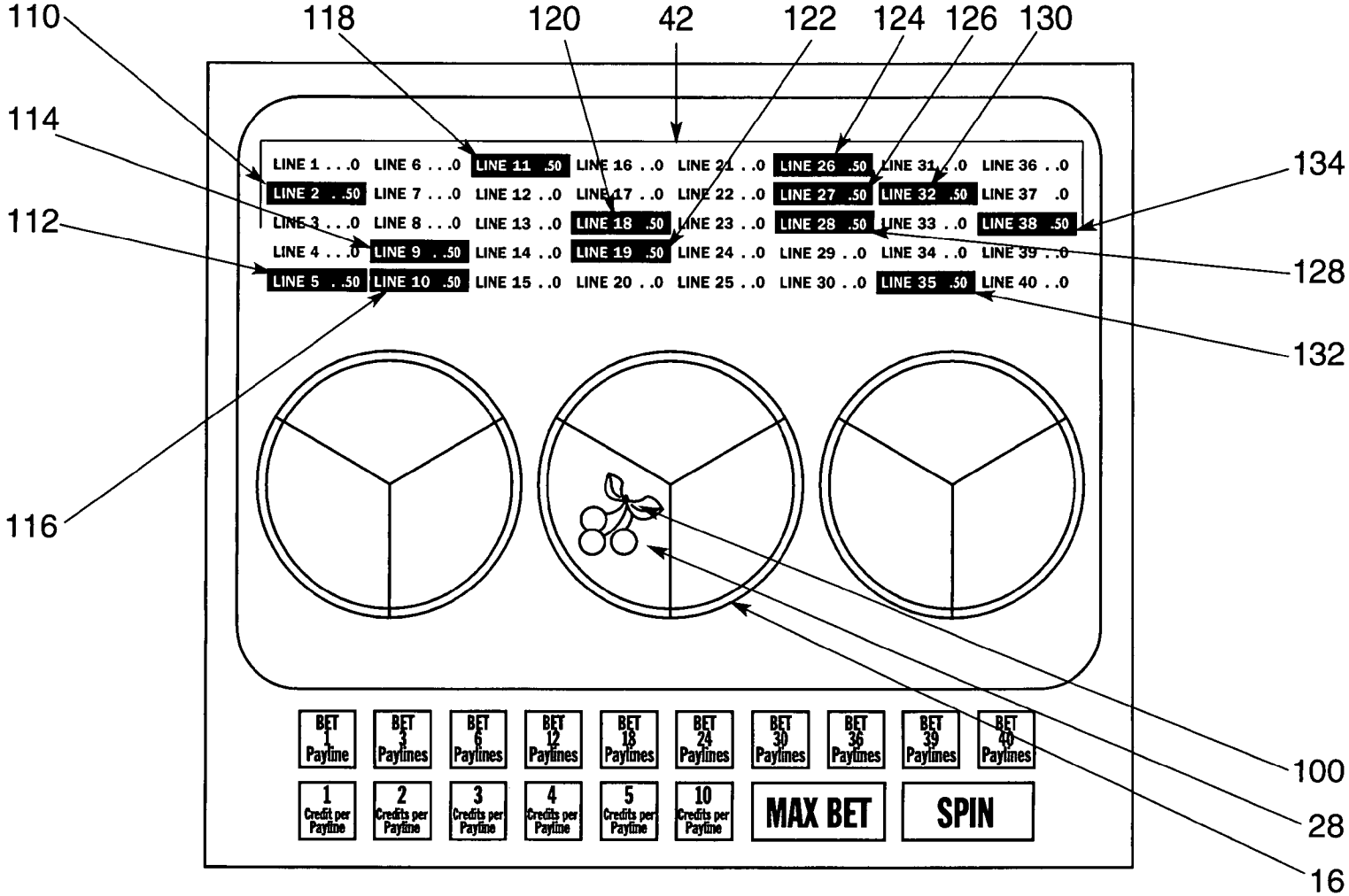
FIG. 6 shows another screen shot of one possible sample stage of a game played with segmented circles as geometric shapes according to teachings herein.

FIG. 6 shows another possible result of the reel spin 70 in FIG. 3. A Cherry symbol 100 is present on a section 28 of the second reel 16, indicating Wins on Pay lines 2, 5, 9, 10, 11, 18, 19, 26, 27, 28, 32, 35, and 38 (110, 112, 114, 116, 118, 120, 122, 124, 126, 128, 130, 132, 134, respectively) as shown in the pay line explanation chart 60 in FIG. 2 and highlighted in the pay line payout chart 42.

Figure 7:
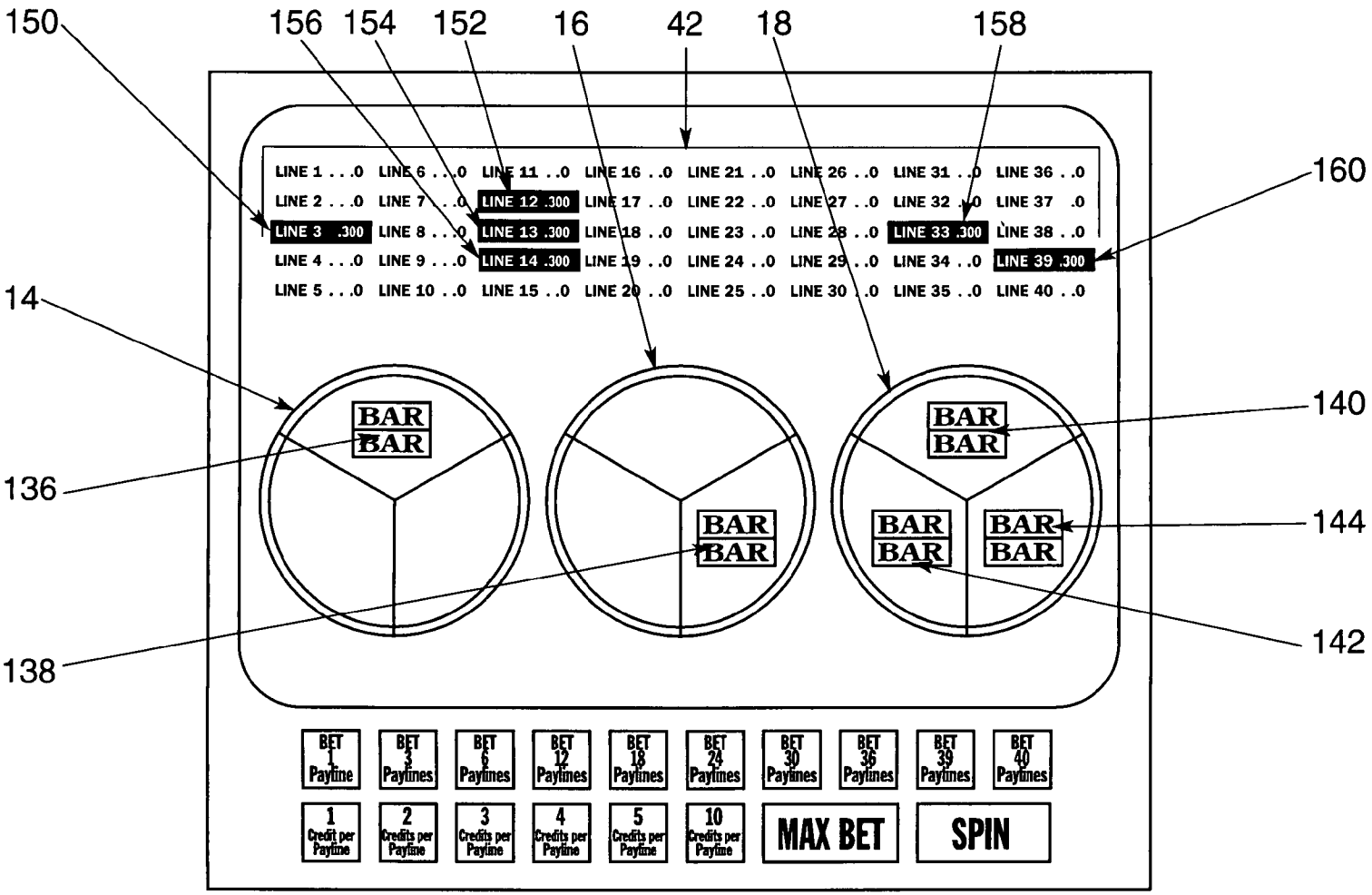
FIG. 7 shows another screen shot of one possible sample stage of a game played with segmented circles as geometric shapes according to teachings herein.

FIG. 7 shows another possible result of the reel spin 70 in FIG. 3. Five Double Bar symbols (136, 138, 140, 142, 144) are present on the three circular reels (14, 16, 18), indicating Wins on Pay lines 3, 12, 13, 14, 33, and 39 (150, 152, 154, 156, 158, 160, respectively) as shown in the pay line explanation chart 60 in FIG. 2 and highlighted in the pay line payout chart 42.

Figure 8:
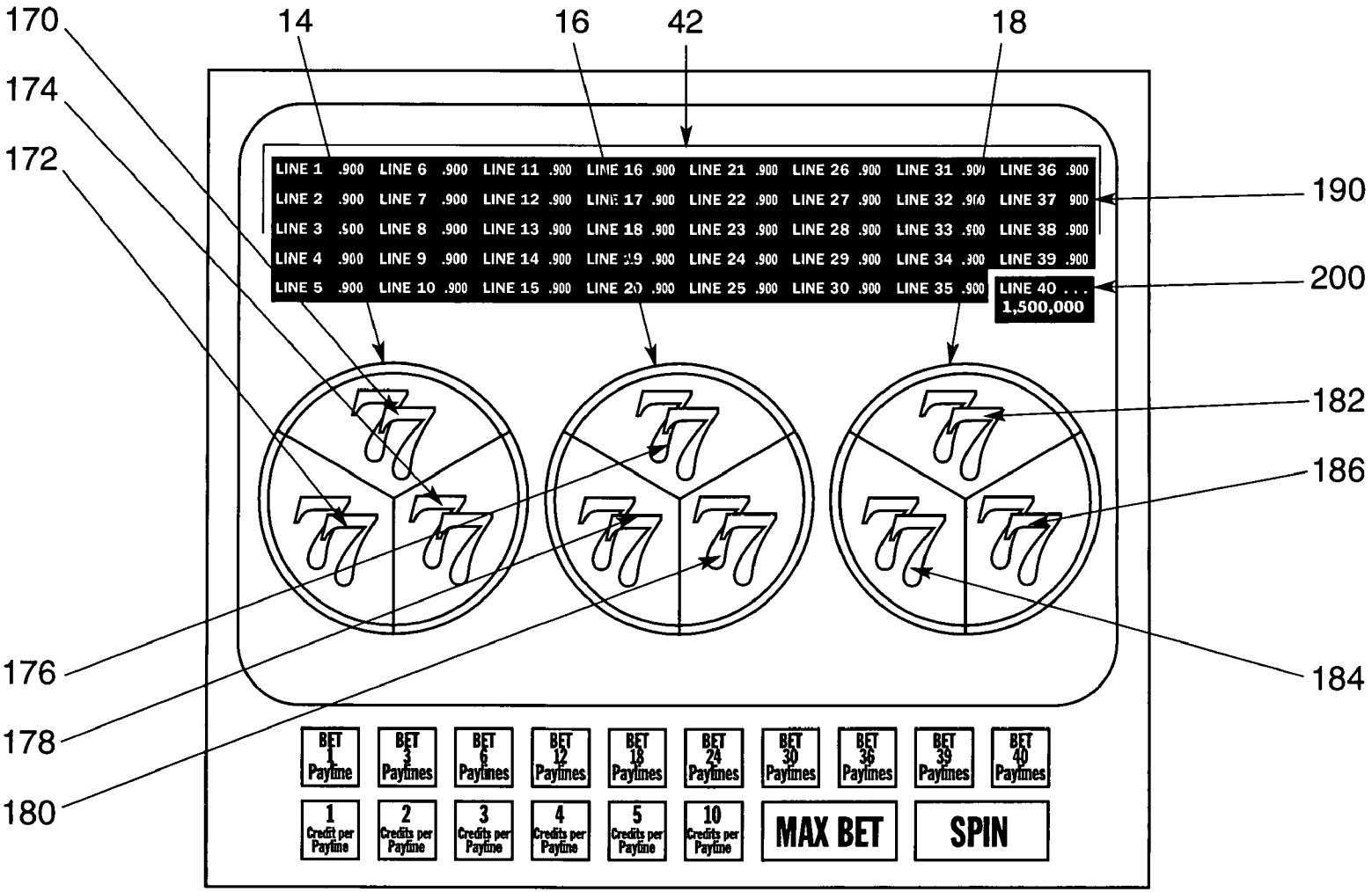
FIG. 8 shows another screen shot of one possible sample stage of a game played with segmented circles as geometric shapes according to teachings herein.

FIG. 8 shows another possible result of the reel spin 70 in FIG. 3. Nine Double Red 7 symbols (170, 172, 174, 176, 178, 180, 182, 184, 186) are present on the three circular reels (14, 16, 18), indicating Wins on Pay lines 1-39 190 and a Win on Pay line 40 200 as shown in the pay line explanation chart 60 in FIG. 2 and highlighted in the pay line payout chart 42. Wins on the 40th Pay line constitute Jackpot Wins varying from 9 Cherries to the top Jackpot Win of Double Red 7s. Any or all of these Jackpot Wins may be a Progressive Award.

Figure 9:
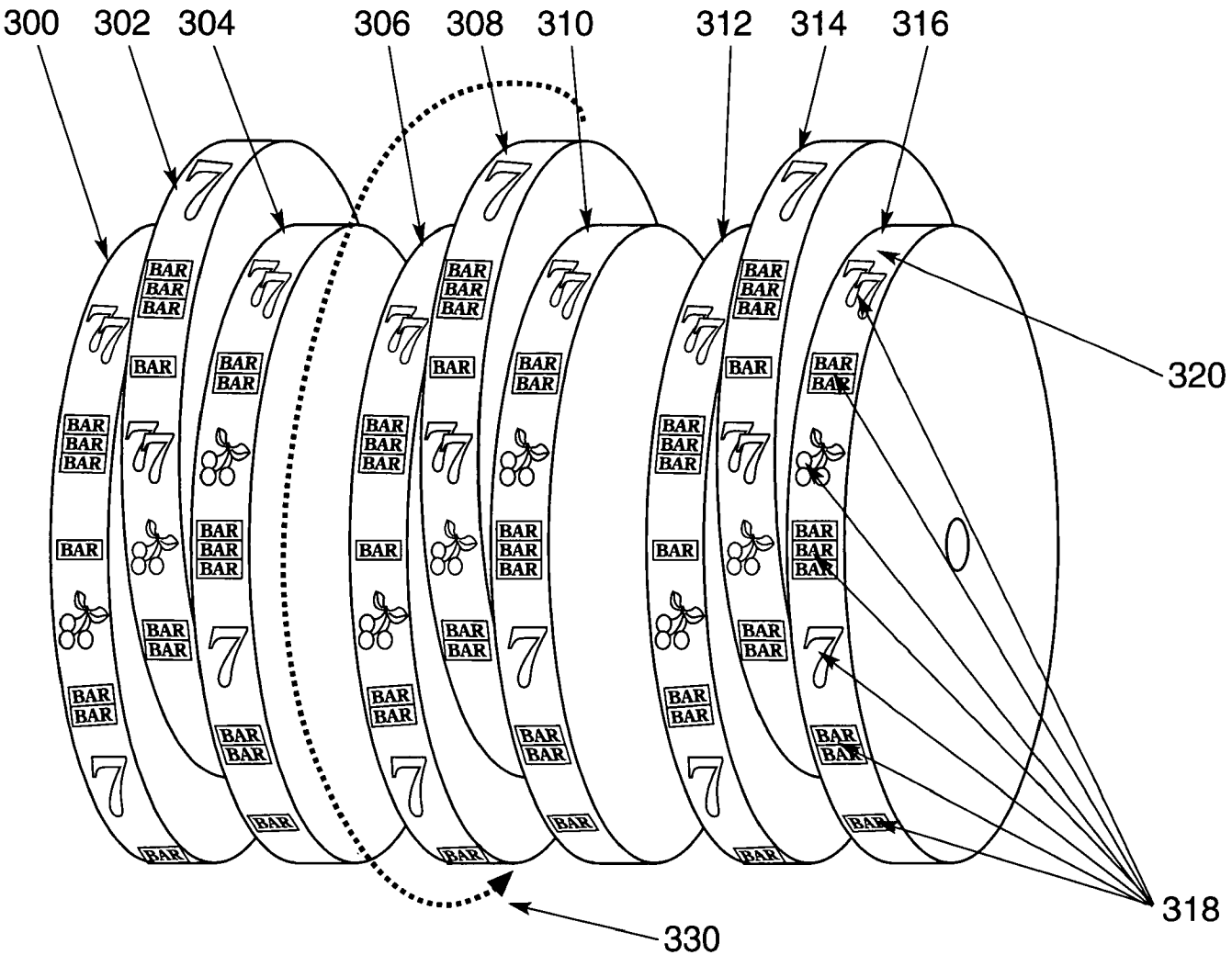
FIG. 9 illustrates nine physical reels for use in a mechanical version of a game played with segmented circles as geometric shapes according to teachings herein.

FIG. 9 shows an array of nine parallel physical circular reels (300, 302, 304, 306, 308, 310, 312, 314, 316), each physical reel having a plurality of various indicia 318 on a reel strip 320. Reels 1 300, 2 302 and 3 304 form a left-hand grouping, with Reel 1 300 and Reel 3 304 centrally positioned along the same plane and Reel 2 302 positioned on a higher plane. Reels 4 306, 5 308 and 6 310 form a center grouping, with Reel 4 306 and Reel 6 310 centrally positioned along the same plane and Reel 5 308 positioned on a higher plane. Reels 7 312, 8 314 and 9 316 form a right-hand grouping, with Reel 7 312 and Reel 9 316 centrally positioned along the same plane and Reel 8 314 positioned on a higher plane. All nine reels (300, 302, 304, 306, 308, 310, 312, 314, 316) rotate 330 independently upon activation.

Figure 10:
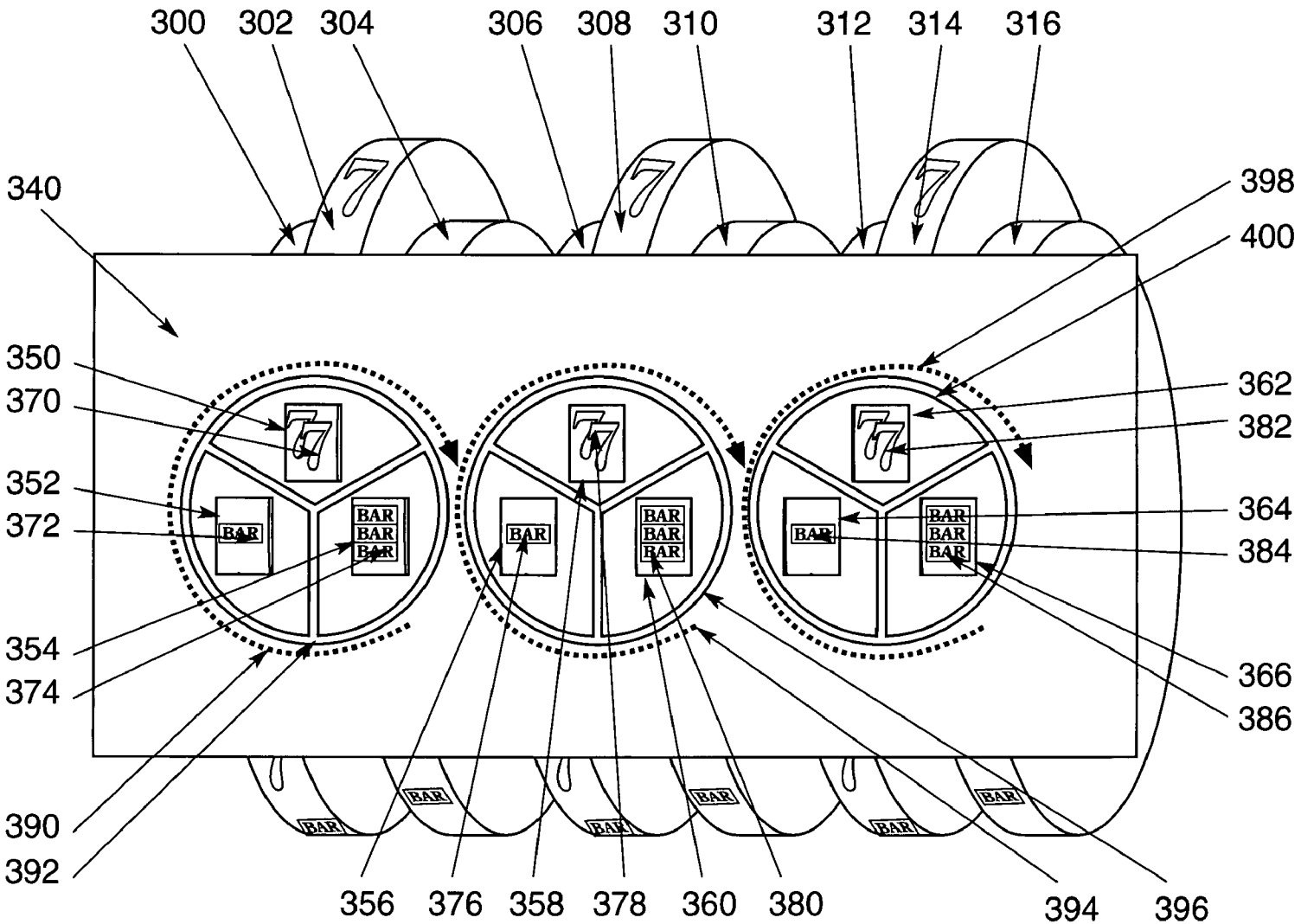
FIG. 10 illustrates a cutaway front view of a mechanical slot machine with a game played with segmented circles as geometric shapes according to the teachings herein.

FIG. 10 shows a cutaway view of a slot machine front panel 340, displaying nine cutout windows (350, 352, 354, 356, 358, 360, 362, 364, 366), exposing nine symbols (370, 372, 374, 376, 378, 380, 382, 384, 386) located on nine parallel physical circular reels (300, 302, 304, 306, 308, 310, 312, 314, 316). A first circular wheel 392 is shown, its 3-sectioned design framing windows 350, 352, 354. The first circular wheel 392 may spin 390 and stop before the main physical reels 300, 302, 304 stop. A second circular wheel 396 is shown, its 3-sectioned design framing windows 356, 358, 360. The second circular wheel 396 may spin 394, stopping after the first circular wheel 392 stops and before the main physical reels 306, 308, 310 stop. A third circular wheel 400 is shown, its 3-sectioned design framing windows 362, 364, 366. The third circular wheel 400 may spin 398, stopping after the second circular wheel 396 stops and before the main physical reels 312, 314, 316 stop. The outcome of the nine-symbol (370, 372, 374, 376, 378, 380, 382, 384, 386) display would be paid according to the wager and a predetermined pay table.

Another way of describing the method of play and the appearance of the games in a wagering device would be as a method of playing a wagering game on a gaming device or apparatus that displays symbols and provides awards on the appearance of predetermined symbols or predetermined arrangements of symbols. The method would comprise: a) a player placing a wager within the wagering game; b) the device or apparatus providing at least three defined areas that can display at least three active symbols within each defined area, each area being divided into distinct sub-areas where the symbols can be provided. These areas could abut each other, slightly overlap, or be completely separate, as long as distinct sub-areas remained available where the position and appearance of displayed symbols could be easily distinguished by visual observation. Symbols are randomly selected (e.g., by a random number generator, mapping, template provision, etc.) to appear within each distinct sub-area. The wager is resolved by determining whether the symbols selected causes a win, tie or loss in the appearance of predetermined symbols or predetermined arrangements of symbols under rules of the wagering game, as exemplified above. The three defined areas are preferably geometric shapes, and more preferably three identical geometric shapes (that is each of the three shapes are identical to the other two shapes). The three identical geometric shapes may be selected from the group consisting of circles, ovals and polygons, equilateral polygons or not. For example, the three identical geometric shapes may selected from the non-limiting group consisting of circles, triangles, squares, rectangles, hexagons and octagons. The paylines within the geometric shapes are predetermined orders or combinations of sub-areas within the geometric shapes. The sub-areas may be demarked by lines within the areas for enhanced visualization of the sub-areas, which may be equal or unequal in area within the at least three areas. The symbols may appear to move within the areas and between sub-areas.

Although specific examples and specific images have been provided in this discussion, these specifics are intended to be only support for the generic concepts of the invention and are not intended to be absolute limits in the scope of the technology discussed.

What is claimed:

1. A method for operating a gaming device, said method comprising:

for a single play of a game:

enabling a wager to be placed on a payline;

causing a display device to display a plurality of areas, each of said areas divided into a plurality of sub-areas;

for at least one but less than all of the sub-areas of each of the areas, randomly determining a symbol from a plurality of different symbols into display in said sub-area, and causing the display device to display said randomly determined symbol in said sub-area;

for each of said areas, randomly determining one of the sub-areas of each of the areas which defines the payline, and causing the display device to display an indication of said randomly determined sub-areas which define the payline, wherein for each of said areas, the random determination of any symbol to display in any sub-area of said area is separate from the random determination of which sub-area of said area defines the payline; and determining if any randomly determined and displayed symbols in the sub-areas which define the payline are one of a plurality of winning symbol combinations, and if any randomly determined and displayed symbols along the payline are one of said plurality of winning symbol combinations, causing the display device to display an award for said winning symbol combination.

2. The method of claim 1, wherein said areas are geometric shapes.

3. The method of claim 2, wherein the displaying symbols in said sub-areas includes rotating said geometric shapes.

4. A method for operating a gaming device, said method comprising:

for a single play of a game:

causing a display device to display a plurality of areas, each of said areas divided into a plurality of sub-areas;

for at least one but less than all of the sub-areas of each of the areas, randomly determining a symbol from a plurality of different symbols to display in said sub-area, and causing the display device to display said randomly determined symbol in said sub-area;

randomly determining at least one of the sub-areas in each of said areas to be evaluated to determine if winning symbols are displayed in said sub-areas, and causing the display device to display an indication of said randomly determined sub-areas which will be evaluated to determine if winning symbols are displayed in said sub-areas, wherein for each of the areas, the random determination of any symbol to display in any sub-area of said area is separate from the random determination of which sub-areas of said area are to be evaluated to determine if winning symbols are displayed; and determining if any award is associated with any randomly determined symbols displayed in the randomly determined sub-areas, and if any award is associated with any randomly determined symbols, causing the display device to display said award.

5. The method of claim 4, wherein said areas are geometric shapes.

6. The method of claim 5, wherein the displaying symbols in said sub-areas includes rotating said geometric shapes.

7. A gaming device comprising:

at least one display device operable to display a plurality of areas, each of said areas divided into a plurality of sub-areas;

at least one input device; and at least one processor configured to operate with the at least one display device and the at least one input device to:

for a single play of a game:

(i) enable a wager to be placed on a payline, (ii) for at least one but less than all of the sub-areas of each of the areas, randomly determine a symbol from a plurality of different symbols to display in said sub-area, and causing the display device to display said randomly determined symbol in said sub-area, (iii) for each of said areas, randomly determine one of the sub-areas of said areas which defines the payline, and causing the display device to display an indication of said randomly determined sub-areas which define the payline, wherein for each of said areas, the random determination of any symbol to display in any sub-area of said area is separate from the random determination of which sub-area of said area defines the payline, and (iv) determine if any randomly determined and displayed symbols in the sub-areas along the payline are one of a plurality of winning symbol combinations, and if any randomly determined and displayed symbols are one of said winning symbol combinations, and cause the display device to display an award for said winning symbol combination.

8. The gaming device of claim 7, wherein said areas are geometric shapes.

9. The gaming device of claim 8, wherein said display of symbols sub-areas includes rotating said geometric shapes.

10. A gaming device comprising:

at least one display device operable to display a plurality of areas, each of said areas divided into a plurality of sub-areas;

at least one input device; and at least one processor configured to operate with the at least one display device and the at least one input device to:

for a single play of a game:

(i) for one of the sub-areas of each of the areas, randomly determine a symbol to display in said sub-area, and cause the display device to display said randomly determined symbol in said sub-area, (ii) randomly determine at least one of the sub-areas in each of said areas to be evaluated to determine if winning symbols are displayed in said sub-areas, and causing the display device to display an indication of said randomly determined sub-areas which will be evaluated to determine if winning symbols are displayed in said sub-areas, wherein for each of the areas, the random determination of any symbol to display in any sub-area of said area is separate from the random determination of which sub-areas of said area are to be evaluated to determine if winning symbols are displayed, and (iii) determine if any award is associated with any randomly determined symbols displayed in the randomly determined sub-areas, and if any award is associated with any randomly determined symbols, causing the display device to display said award.

11. The gaming device of claim 10, wherein said areas are geometric shapes.

12. The gaming device of claim 11, wherein said display of a symbol in said sub-areas includes rotating said geometric shapes.

* * * * *

UNITED STATES PATENT AND TRADEMARK OFFICE

CERTIFICATE OF CORRECTION

PATENT NO. : 7,601,061 B2
APPLICATION NO. : 11/057393
DATED : October 13, 2009
INVENTOR(S) : Kathleen Nylund Jackson It is certified that error appears in the above-identified patent and that said Letters Patent is hereby corrected as shown below:

IN THE CLAIMS:

In Claim 1, Column 6, line 29, replace "into" with --to--.

In Claim 7, Column 8, line 1, delete "and".

Signed and Sealed this

Twentieth Day of July, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,601,061 B2
APPLICATION NO. : 11/057393
DATED : October 13, 2009
INVENTOR(S) : Kathleen Nylund Jackson It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 363 days.

Signed and Sealed this

Fifth Day of October, 2010

David J. Kappos

David J. Kappos
*Director of the United States Patent and Trademark Office*